US005816826A

United States Patent [19]

Colemen

[11] Patent Number: 5,816,826

[45] Date of Patent: Oct. 6, 1998

[54] COMPUTER CIRCUIT BOARD WITH DIRECT CONNECT PERIPHERAL SLOT ASSEMBLY

[75] Inventor: Allen M. Colemen, Troy, Tex.

[73] Assignee: Texas Instruments Incorporated, Dallas, Tex.

[21] Appl. No.: 663,888

[22] Filed: Jun. 14, 1996

[51] Int. Cl.[6] ..... H01R 9/09

[52] U.S. Cl. ..... 439/64; 439/79

[58] Field of Search ..... 439/64, 79, 80, 439/541.5; 29/842

[56] References Cited

U.S. PATENT DOCUMENTS

| | | | |
|---|---|---|---|
| 5,286,207 | 2/1994 | McHugh | 439/64 |
| 5,316,488 | 5/1994 | Gardner et al. | 439/79 |
| 5,364,275 | 11/1994 | Ota et al. | 439/79 |
| 5,511,986 | 4/1996 | Casey et al. | 439/64 |
| 5,605,463 | 2/1997 | MacGregor et al. | 439/64 |

*Primary Examiner*—Neil Abrams
*Assistant Examiner*—T. C. Patel
*Attorney, Agent, or Firm*—Ronald O. Neerings; James C. Kesterson; Richard L. Donaldson

[57] ABSTRACT

A computer (40) has one or more PC Card peripheral slot assemblies (41*a*, 41*b*). The peripheral slot assemblies (41*a*, 41*b*) have leads (60*a*, 60*b*) which connect in a substantially straight line from receptacles on the PCMCIA device (66) to a SMT connector (58) on a circuit board (64). Two PCMCIA peripheral slots (41*a*, 41*b*) can be mounted on either side of the circuit board (64) to reduce overall thickness in a notebook computer (40).

20 Claims, 4 Drawing Sheets

COMPUTER CIRCUIT BOARD WITH DIRECT CONNECT PERIPHERAL SLOT ASSEMBLY

BACKGROUND OF THE INVENTION

1. Technical Field

This invention relates in general to computers and, more particularly, to a peripheral slot assembly for receiving peripheral devices.

2. Description of the Prior Art

For many years, the popularity of portable computers has risen as the size and weight of the portable computer has been reduced. Early portable computers were known as "luggable" computers, since they could be transported, but were only slightly smaller and lighter than comparable desktop computers. "Laptop" computers were smaller and lighter, but generally had reduced features and flexibility because most of the circuitry needed to be designed into the laptop motherboard without the option of expansion boards.

"Notebook" computers are significantly smaller and lighter than laptop computers. These computers can be carried easily in a briefcase. Unlike desktop computers, notebook computers generally do not provide any internal bus slots for peripheral devices other than extra memory. Many common peripherals, such as a hard drive, serial and parallel ports, and often a modem, are built into the system board(s) of the notebook computer. Other peripherals, such as network interfaces and faster modems, are available to the user through one or more peripheral slots which are externally available. While some proprietary slots have been used in the past, most notebooks offering peripheral slots now use one or more PCMCIA (Personal Computer Memory Card International Association) slots. A higher speed version of PCMCIA is referred to as "CardBus"; these slots provide a higher data rate and are backwards-compatible with PCMCIA. The pinouts for PCMCIA and CardBus are the same, with CardBus slots having an additional ground connector to support the higher speed. Both CardBus and PCMCIA slots are referred to as PC Card slots.

A problem with peripheral slots has been their relatively high cost of manufacturability. In one method of attaching a peripheral slots to a PWB (printed wiring board), the leads of the peripheral slot are bent downward at an approximate 90° angle to mate with the PWB at the point of the solder connections to each lead. Since there are two parallel rows of leads, this requires two bending operations—one for each row of leads. Each lead may have a slightly different "memory"; i.e., each lead will deform slightly differently to the bending operation. Accordingly, in many cases, the bent leads will not be precisely aligned after bending.

For a reliable solder connection, the leads must be aligned within a predetermined threshold, typically on the order of ±3 mils. If such a precise alignment is not possible, a second step is necessary. The second step involves using a "hot bar" to hold down the leads while the solder is reflowed and cooled, in order to ensure that each lead is in contact with its solder point as the connection is formed.

Another method of connecting the peripheral slot assemblies to a PWB involve bending the leads of the peripheral slot at a 90° angle and inserting the bent leads into a vertical SMT (surface mount technology) connector. This approach requires additional steps in forming the leads and needs an alignment plate for insertion into the SMT connector, both of which drive up costs.

A third method uses an interface board which is connected to the leads of the peripheral slot to a PCB (printed circuit board) interface board. The interface board is then coupled to a vertical SMT connector on a PWB in the notebook computer during assembly. The addition of the PCB interface board adds steps and cost to the fabrication of the computer. Furthermore, this method requires substantial height which may increase the thickness of the notebook computer.

Therefore, a need has arisen for mounting a peripheral slot assembly on a computer PWB which reduces cost, increases reliability and does not add size constraints to the computer.

SUMMARY OF THE INVENTION

The present invention provides a computer including a housing and a circuit board disposed within the housing. A peripheral slot assembly is disposed adjacent an opening in the housing and is operable to receive a peripheral device through the housing, wherein the peripheral device has a plurality of contacts arranged in a predetermined array for transmitting and receiving signals. The peripheral slot includes a plurality of substantially straight leads arranged in an array to mate with said predetermined array of contacts. A connector is mounted to the circuit board and has a plurality of receptacles arranged to mate with the leads, such that the straight leads of said peripheral slot may be connected to said connector without bending.

The present invention provides significant advantages over the prior art. First, the cost of the peripheral slot assembly is greatly reduced, because precise lead bending is eliminated. Second, the cost of assembly is reduced, because no rework is necessary to ensure proper contact between the leads and the circuit board. Third, slot assemblies can be mounted on opposite sides of a circuit board to reduce the overall thickness of a notebook computer.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

The present invention is best understood in relation to FIGS. 1–5 of the drawings, like numerals being used for like elements of the various drawings.

Figure 1A:
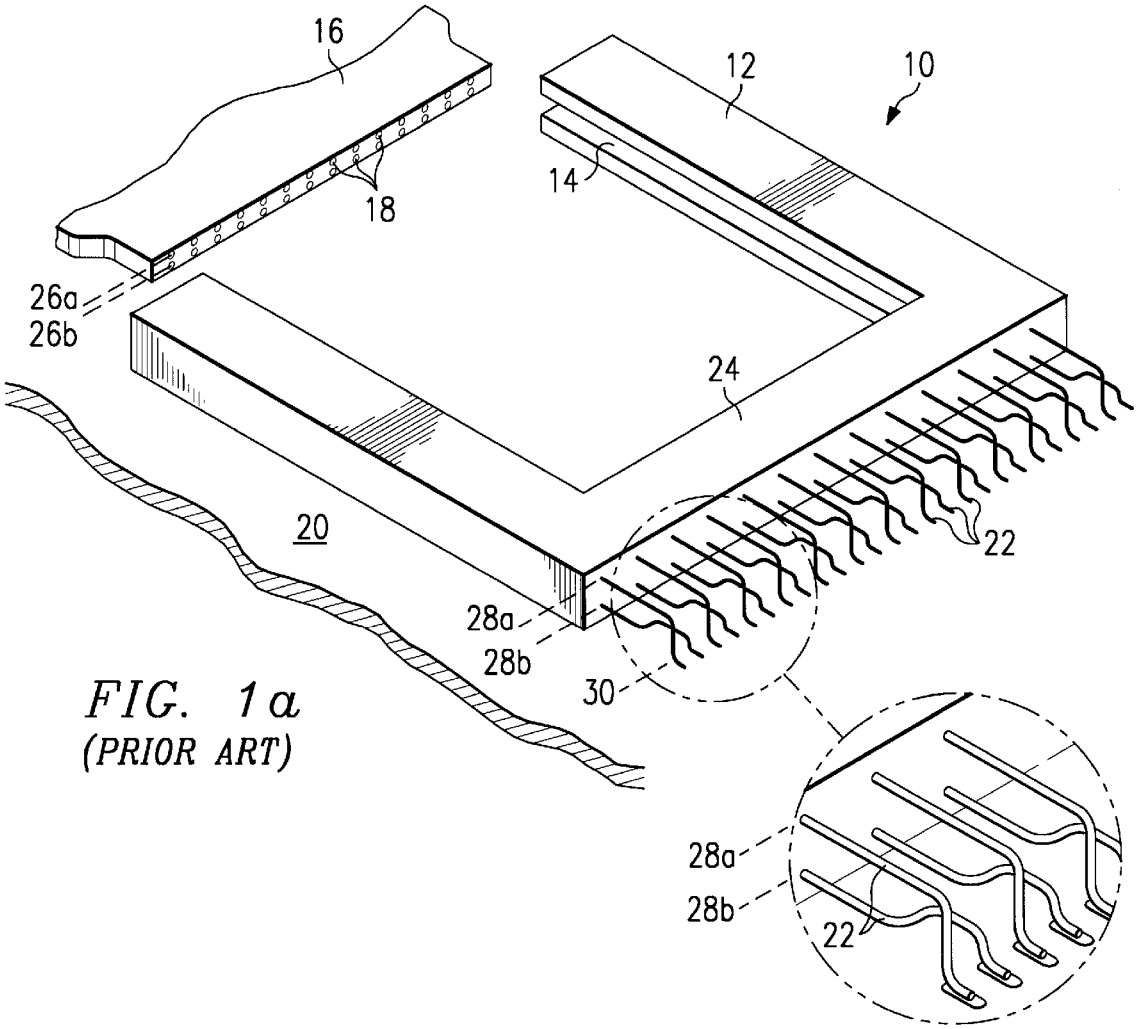
FIG. 1a (PRIOR ART)
FIGS. 1*a* and 1*b* illustrate perspective and side views of prior art peripheral slot assemblies.

FIG. 1*a* illustrates a perspective view of a prior art peripheral slot assembly 10 with an exploded view showing bending of the pins. The assembly includes arms 12 with a channel 14 formed therein for receiving a device 16, such as a PCMCIA or a CardBus device. The device 16 has a plurality of receptacles 18 which are connected to a computer PWB 20 via the assembly 10. The receptacles 18 mate with leads 22 disposed at the front end 24 of the assembly 10. The leads 22 protrude through the front end 24 of the assembly, where they are bent downward to attach to the PWB 20.

In the PC Card specification, the receptacles 18 are arranged in two rows, shown in FIG 1*a* as rows 26*a* and 26*b*. Accordingly, the portion of the leads 22 inside the front end are arranged in two rows 28*a* and 28*b*. The leads 22 are typically bent so that the connections to the PWB 20 is made along a single row 30, which eases any rework performed on the leads. This requires, however, that one row of leads (the bottom row 28*b* in FIG. 1*a*) are bent both vertically and horizontally, which increases the cost of the assembly 10.

Figure 1B:
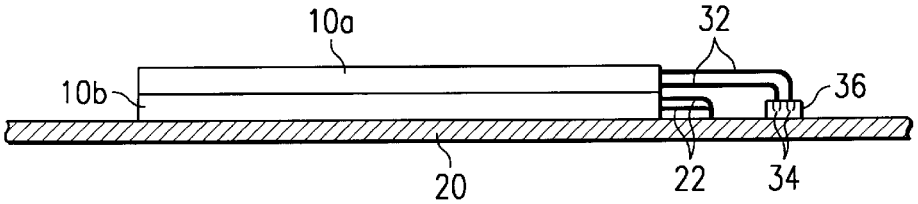
FIG. 1b (PRIOR ART)

FIG. 1*b* illustrates a side view of a PWB 20 supporting dual peripheral slot assemblies 10*a* and 10*b*. The first slot assembly 10*a* has leads bent as shown in connection with FIG. 1*a*. The second assembly 10*b* has leads 32 arranged in two rows. The leads 32 in each row are bent vertically to mate with two rows of receptacles 34 in a vertical SMT connector 36.

Both of the peripheral slot assemblies 10*a* and 10*b* have high costs associated with manufacturing steps for connecting the assemblies to the board. The lower assembly 10*a* has high costs associated with bending the leads and with additional steps required to ensure that all leads are properly soldered to the PWB. The upper assembly 10*b* has high costs associated with bending the leads and in the use of an alignment plate for proper insertion of the leads into the vertical SMT connector.

Figure 2:
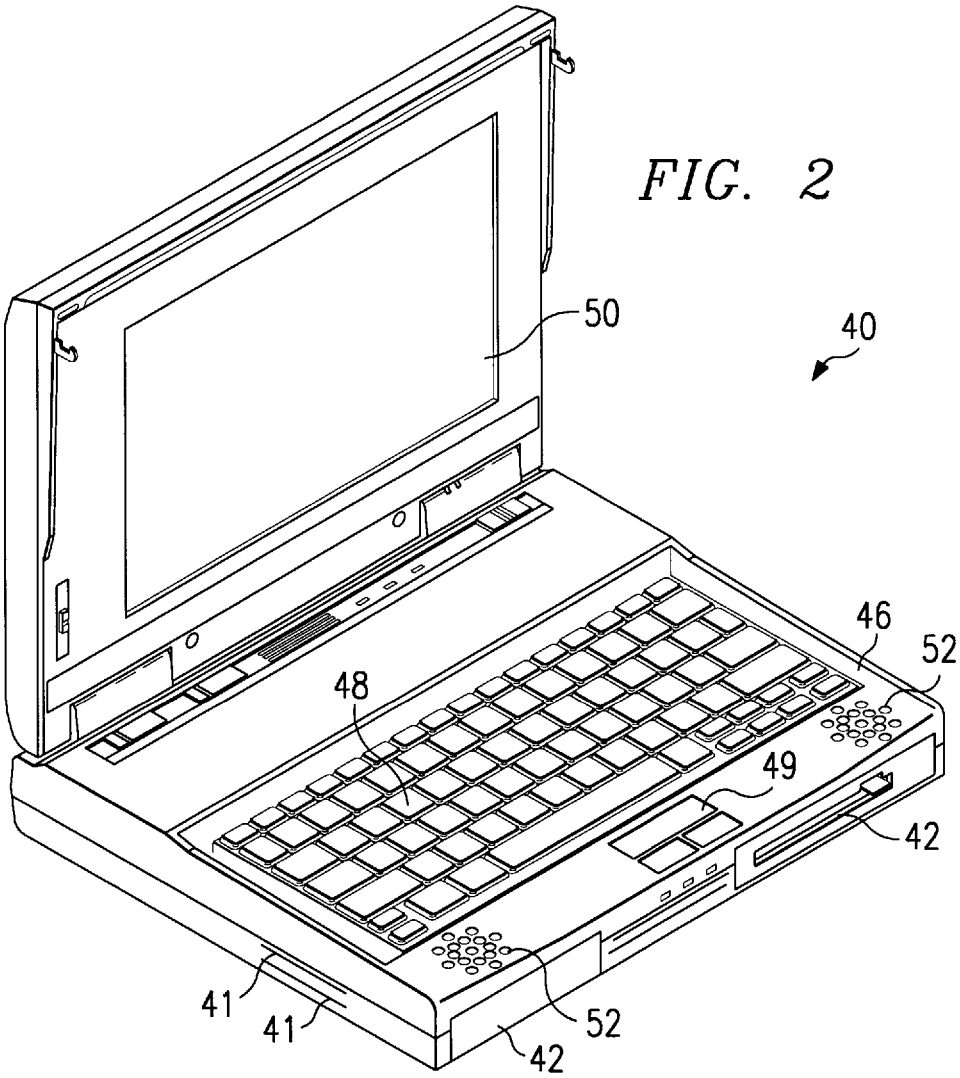
FIG. 2 illustrates a notebook computer.

FIG. 2 illustrates a perspective view of a notebook computer system 40 having two peripheral slots 41 assemblies for receiving two peripheral devices, such as modems, network interfaces, hard drives or sound cards. Modular bays 42 can be used for larger devices such as floppy drives, hard disk drives, CD-ROMs, magneto-optical (MO) drives, batteries, or cellular telecommunication devices. The computer system 40 includes a main housing 46, within which the computer electronics are housed. The peripheral slot assemblies 41 are accessible through the housing. A keyboard 48 is placed at the top of the main housing 46. Keyboard 48, in the preferred embodiment, includes a pointing device, such as touch pad 49. A display 50 is attached to the main housing 46. Typically, the display 50 is connected to the main housing 46 by a hinge, such that the display 50 can be folded away from the main housing 46 when the computer 40 is in use and folded flush with the main housing 46 for portability when the computer 40 is inactive. For a multimedia computer, speakers 52 are shown in the main housing 46.

While FIG. 2 illustrates a specific notebook computer design, it should be noted that many modifications could be made. For example, many different pointing devices could be used, such as a mouse, a trackball or an integrated joystick. Other features, such as speakers and modular bays are optional and not needed to practice the present invention, as would be known to one skilled in the art.

Figure 3:
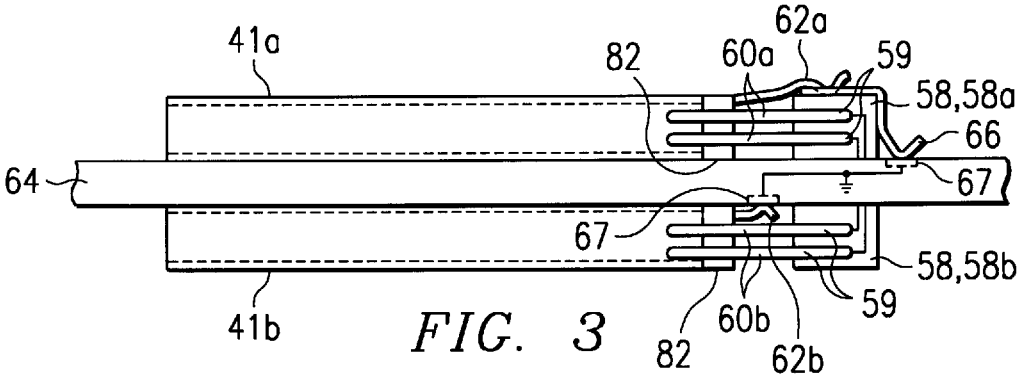
FIGS. 3 illustrates a side view of peripheral slots mounted on top and bottom sides a circuit board in the computer.
Figure 4A:
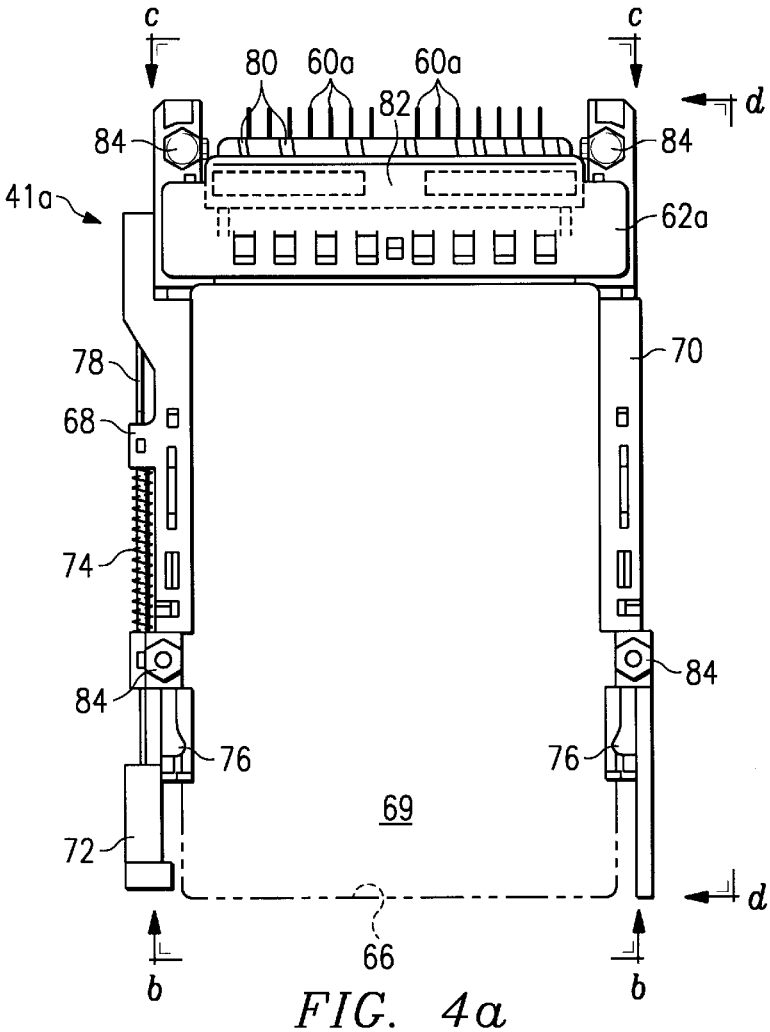
FIGS. 4*a–d* illustrate top, back, front and side views of a top peripheral slot assembly.
Figure 4B:
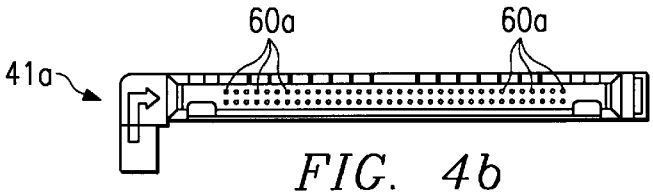
Figure 4C:
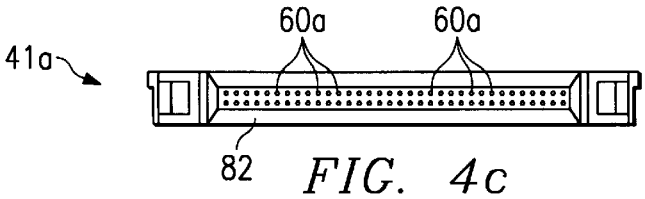
Figure 4D:
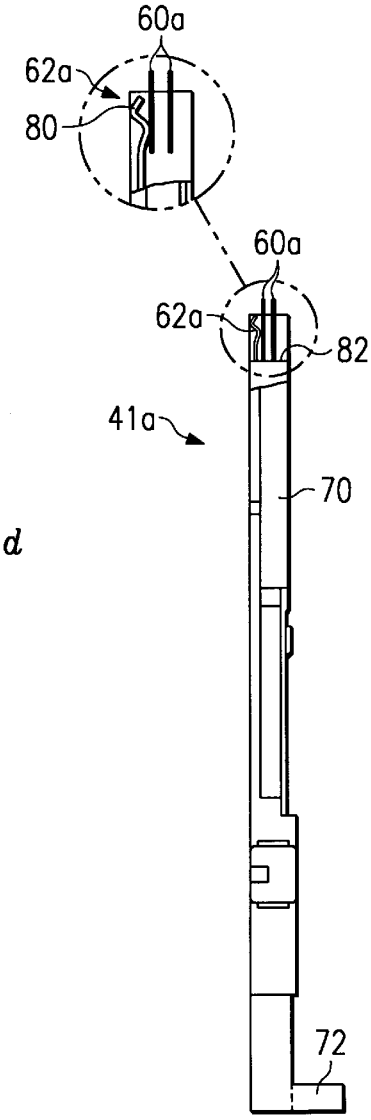
Figure 5A:
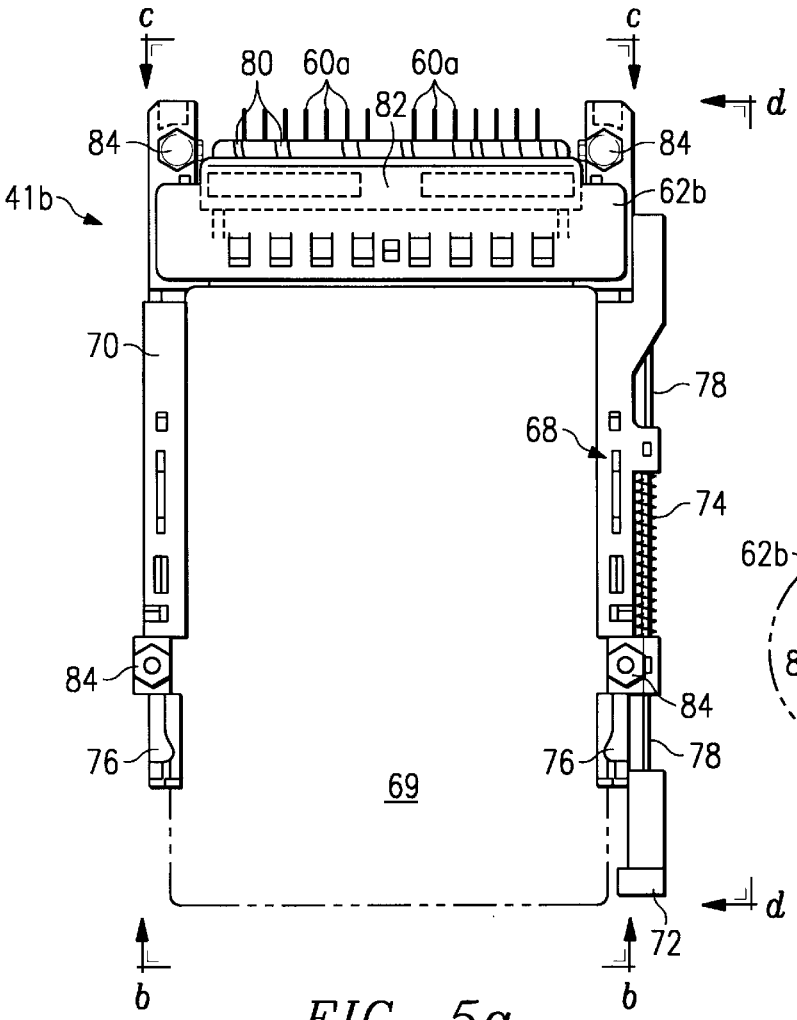
FIGS. 5*a–d* illustrate top, back, front and side views of a bottom peripheral slot assembly.
Figure 5B:
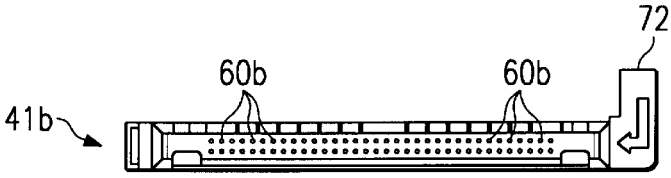
Figure 5C:
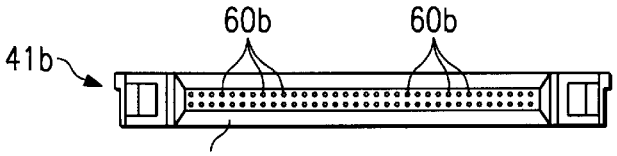
Figure 5D:
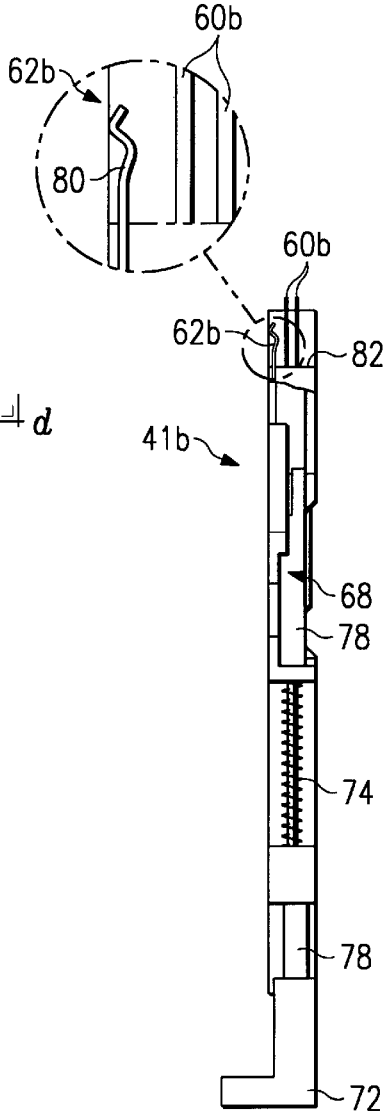

FIG. 3 illustrates a side view of a computer PWB 64 having dual peripheral slot assemblies 41*a* and 41*b* mounted on either side of the PWB 54. Horizontal SMT connectors 58 (referenced individually as connectors 58*a* and 58*b*) having receptacles 59 are connected to straight leads 60*a* and 60*b* disposed outward of the respective peripheral slot assemblies 41*a* and 41*b*. Ground connectors 62*a* and 62*b* are coupled to respective peripheral slot assemblies 41*a* and 41*b;* ground connector 62*a* is coupled to a ground plane 66 disposed on SMT connector 58*a* and ground connector 62*b* is coupled to ground contacts 67 on the PWB 64. Ground plane 66 is coupled to ground contacts 67 on the PWB 64.

PWB 64 may be one of a plurality of boards providing the electronic circuitry for the computer or may be a single board on which all internal circuitry is disposed. Such board or boards contain the processor, BIOS, memory, serial and parallel interfaces, video/graphics controller, and so on. Receptacles 59 in SMT connectors 58 are designed to match the spacing of the PC Card receptacles. The leads 60*a* and 60*b* are straight, or substantially straight, such that the respective assemblies 41*a* and 41*b* can be connected to connectors 58*a* and 58*b* without bending the leads 60*a* and 60*b*.

Ground connectors, such as the connectors shown at reference numerals 62*a* and 62*b,* are required by the CardBus specification for providing a solid ground connection to the PWB 64. In the embodiment shown, the ground connectors 62*a* and 62*b* have spring members, shown in greater detail in connection with FIGS. 4*d* and 5*d,* respectively, which press against metal contacts 67 on the PWB 64, either directly or through ground plane 66.

The design shown in FIG. 3 has two principal advantages: (1) the assemblies 41*a* and 41*b* can be mounted on both sides of the PWB 64, which reduces the height needed between the PWB 64 and the housing 46 and (2) the assemblies do not require extra manufacturing steps to bend and align the leads 60*a* and 60*b* for connection to the PWB 64. Accordingly, the cost of the computer 40 and its thickness are reduced.

FIGS. 4*a–d* illustrate top, back, front and side views of peripheral assembly 41*a*. A device 69 is shown in phantom in FIG. 4*a* as inserted into the assembly 41*a*. The device 69 slides within side arms 68 and 70. A locking mechanism, including lever 72, spring 74, latches 76 and rod 78 maintains the device 69 within the assembly 41*a* once it is fully inserted. Lever 72 may be rotated to eject a fully inserted device. The locking mechanism is standard and, as would be understood by one skilled in the art, other locking mechanisms could be substituted to provide an identical function.

Ground connector 62*a,* per the CardBus specification, is mounted at the top of the slot assembly 41*a*. The ground connector 62*a,* shown in detail in connection with FIGS. 4*c–d,* has a plurality of spring members 80. When mounted in SMT connector 58*a,* spring members 80 press again ground plane 66, which is in turn connected to ground contacts 67 on the circuit board 64. In the illustrated embodiment, the spring members 80 for the ground connector 62*a* extend 4.43 millimeters from the front plane of the front piece 82 of the slot assembly 41*a,* although this distance is dependent upon the distance from the front of the slot assembly 41*a* from the SMT connector 58*a* on the circuit board 64.

Leads 60*a* protrude through front piece 82 to connect with both the device 69 and the SMT connector 58*a*. The leads are designed, in the preferred embodiment, to be substantially straight for the entire length from device 66 to connector 58*a* to eliminate any cost involved in bending the leads.

The slot assembly 41*a* is mounted on the circuit board 64 after all components, including SMT connector 58*a* have been mounted. The slot assembly 41*a* is slid onto the board 64 such that leads 60*a* are received in receptacles 59 of SMT connector 58*a*. Ground connector 62*a* slides over ground plane 66, such that spring members 80 are in contact with the ground plane 66.

FIGS. 5*a–d* illustrate top, back, front and side views of peripheral assembly 41*b*. Slot assembly 41*b* is of similar construction as slot assembly 41*a,* except as noted hereinbelow, and like reference numbers as used for similar parts. A device 69 is shown in phantom in FIG. 5*a* as inserted into the assembly 41*b*. Slot assembly 41*b* is designed such that devices 66 are oriented in the same direction (i.e., top up) regardless of which slot assembly, 41*a* or 41*b,* is being used. The device 66 slides within side arms 68 and 70. A locking mechanism, including lever 72, spring 74, latches 76 and rod 78 maintains the device 69 within the assembly 41*a* once it is fully inserted. Lever 72 may be rotated to eject a fully inserted device.

Ground connector 62*b,* per the CardBus specification, is mounted at the top of the slot assembly 41*a,* which is the side of the slot assembly 41*b* nearest the circuit board. The ground connector 62*b,* shown in detail in connection with FIGS. 5*c–d,* has a plurality of spring members 80. When mounted in SMT connector 58*b,* spring members 80 press against ground contacts 67 on the circuit board 64 to make electrical contact. In the illustrated embodiment, the spring members 80 for the ground connector 62*b* extend 3.05 millimeters from the front plane of the front piece 82 of the slot assembly 41*b*. The spring members 80 of ground connector 62*b* are shorter because they connect to nodes between the front piece 82 of slot assembly 41*b* and the SMT connector 58*b,* as opposed to the spring members 80 of slot assembly 41*a,* which make contact on top of SMT connector 58*a*.

Leads 60*b* protrude through front piece 82 to connect with both the device 69 and the SMT connector 58*b*. The leads 62*b* are designed, in the preferred embodiment, to be substantially straight for the entire length from device 66 to connector 58*b* to eliminate any cost involved in bending the leads.

The slot assembly 41*b* is mounted on the circuit board 64 after all components, including SMT connector 58*b* have been mounted. The slot assembly 41*b* is slid onto the board 64 such that leads 60*b* are in contact with ground contacts 67.

Once slot assemblies 41*a* and 41*b* have been properly mounted in SMT connectors 58*a* and 58*b,* respectively, the assemblies 41*a–b* can be secured to the board using screws disposed through holes 84. In the preferred embodiment, holes 84 of the assemblies 41*a–b* are aligned such that four screws can secure both assemblies.

In the preferred embodiment, slot assemblies 41*a* and 41*b* are mounted on opposite sides of the circuit board 64. Each circuit board will have some space on either side to allow for cooling of the electrical components during operation of the computer 40. By mounting the slot assemblies 41*a–b* on opposite sides of the circuit board 64, the overall thickness of the notebook computer can be reduced, since additional space will not be needed to accommodate the extra height of the slot assemblies, as can be necessary when both assemblies are mounted on one side of the board (see FIG. 1*b*). Mounting prior art slot assemblies on opposite sides of a circuit board would be difficult because of the upward bending of the leads for the lower assembly, along with the CardBus requirement that the ground connector be on top of the slot assembly.

The present invention provides significant advantages over the prior art. First, the cost of the peripheral slot assembly is greatly reduced, because precise lead bending is eliminated. Second, the cost of assembly is reduced, because no rework is necessary to ensure proper contact between the leads and the circuit board. Third, slot assemblies can be mounted on opposite sides of a circuit board to reduce the overall thickness of a notebook computer.

Although the Detailed Description of the invention has been directed to certain exemplary embodiments, various modifications of these embodiments, as well as alternative embodiments, will be suggested to those skilled in the art. Terms such as "upper", "lower", "top", and "bottom" are used to describe relative orientation between components, it being understood that the computer may be held in various positions where and "upper" surface, for example, would be closer to the ground than a "lower" surface. The invention encompasses any modifications or alternative embodiments that fall within the scope of the claims.

What is claimed is:

1. A computer comprising:

a housing;

a circuit board disposed within said housing;

a peripheral slot assembly disposed adjacent an opening in said housing and operable to receive a peripheral device through said opening, wherein said peripheral device has a plurality of contacts arranged in a predetermined array for transmitting and receiving signals, said peripheral slot including a plurality of substantially straight leads arranged in an array corresponding to said predetermined array to mate with said contacts;

a connector mounted to said circuit board, said connector having a plurality of receptacles arranged corresponding to said predetermined array such that said straight leads of said peripheral slot mate with said receptacles without bending the leads.

2. The computer of claim 1 wherein said connector comprises a plurality of receptacles aligned parallel to said circuit board for receiving said leads.

3. The computer of claim 1 wherein said peripheral slot assembly comprises a PC Card slot assembly.

4. The computer of claim 3 wherein said PC Card slot assembly comprises a PCMCIA slot assembly.

5. The computer of claim 3 wherein said PC Card slot assembly comprises a CardBus slot assembly.

6. The computer of claim 3 wherein said connector is a SMT connector.

7. The computer of claim 1 wherein said connector is grounded to said circuit board.

8. The computer of clam 7 wherein said connector is grounded to said circuit board via a grounding mechanism that electrically connects said connector to a ground contact on said circuit board.

9. The computer of claim 7 wherein said peripheral slot assembly further includes a ground connector for grounding said peripheral slot assembly to said connector.

10. The computer of claim 1 further including:

a second peripheral slot assembly disposed adjacent an opening in said housing and operable to receive a second peripheral device through said opening, wherein said second peripheral device has a plurality of contacts arranged in a predetermined array for transmitting and receiving signals, said second peripheral slot including a plurality of substantially straight leads arranged in an array corresponding to said predetermined array to mate with said contacts; and a second connector mounted to a second side of said circuit board, said second connector having a plurality of receptacles arranged corresponding to said predetermined array such that said straight leads of said peripheral slot mate with said receptacles without bending the leads.

11. The computer of claim 10, wherein said second peripheral slot assembly is disposed on said circuit board directly opposite said peripheral slot.

12. The computer of claim 10 wherein said connector is grounded to said circuit board.

13. The computer of claim 12 wherein said second connector is grounded to said circuit board via a grounding mechanism that electrically connects said second connector to a ground contact on said circuit board.

14. The computer of claim 12 wherein said peripheral slot assembly further includes a ground connector for grounding said peripheral slot assembly to said connector.

15. A computer comprising:

a circuit board having first and second sides;

a first peripheral slot assembly coupled to said first side of said circuit board for receiving a peripheral device having a plurality of contacts arranged in a predetermined array for transmitting and receiving signals, said first peripheral slot assembly including a plurality of substantially straight leads arranged in an array corresponding to said predetermined array to mate with said contacts;

a second peripheral slot assembly coupled to said second side of said circuit board opposite said first peripheral slot for receiving a peripheral device having a plurality of contacts arranged in said predetermined array for transmitting and receiving signals, said second peripheral slot assembly including a plurality of substantially straight leads arranged in an array corresponding to said predetermined array to mate with said contacts; and first and second connectors coupled to said circuit board for receiving said plurality of straight leads from said first and second peripheral slot assemblies, respectively.

16. The computer of claim 15 wherein said first peripheral slot assembly is grounded to said circuit board.

17. The computer of claim 15 wherein said second peripheral slot assembly is grounded to said circuit board.

18. The computer of claim 15 wherein said first and second connectors comprise connectors having a plurality of receptacles disposed parallel to said circuit board.

19. The computer of claim 18 wherein said receptacles are arranged corresponding to said predetermined array.

20. The computer of claim 18 wherein said first and second connectors are horizontal SMT connectors.

* * * * *